US012330081B2

(12) United States Patent
Webb et al.

(10) Patent No.: US 12,330,081 B2
(45) Date of Patent: Jun. 17, 2025

(54) THREE-DIMENSIONAL TRANSFORMABLE TOY

(71) Applicant: Sene Webb LLC, Weston, FL (US)

(72) Inventors: Ian M. Webb, Weston, FL (US); Regina Sene Webb, Weston, FL (US)

(73) Assignee: Sene Webb LLC, Weston, FL (US)

( * ) Notice: Subject to any disclaimer, the term of this patent is extended or adjusted under 35 U.S.C. 154(b) by 220 days.

(21) Appl. No.: 18/102,871

(22) Filed: Jan. 30, 2023

(65) Prior Publication Data

US 2023/0241524 A1 Aug. 3, 2023

Related U.S. Application Data

(60) Provisional application No. 63/305,017, filed on Jan. 31, 2022.

(51) Int. Cl.

| | |
|---|---|
| ***A63H 3/02*** | (2006.01) |
| ***A63H 3/12*** | (2006.01) |
| ***A63H 3/36*** | (2006.01) |
| ***A63H 33/00*** | (2006.01) |

(52) U.S. Cl.

CPC ..... *A63H 33/004* (2013.01); *A63H 3/02* (2013.01); *A63H 3/12* (2013.01); *A63H 3/36* (2013.01)

(58) Field of Classification Search

CPC ..... A63H 3/02; A63H 3/12

See application file for complete search history.

(56) References Cited

U.S. PATENT DOCUMENTS

| | | | | |
|---|---|---|---|---|
| 3,851,419 | A | 12/1974 | Kaelin | |
| 4,413,442 | A | 11/1983 | McSweeney | |
| 4,614,505 | A * | 9/1986 | Schneider | A63H 33/004 446/369 |
| 4,648,851 | A | 3/1987 | Rosenberg | |
| 4,781,648 | A | 11/1988 | Garfinkel | |
| 5,090,938 | A * | 2/1992 | Reynolds | G09B 19/0061 434/137 |
| 5,115,528 | A | 5/1992 | Lamle | |
| 5,310,378 | A | 5/1994 | Shannon | |
| 6,264,526 | B1 | 7/2001 | Meeker | |
| 8,672,724 | B2 | 3/2014 | Beuerle | |
| 10,869,462 | B2 | 12/2020 | Glenn | |
| 2003/0114074 | A1 | 6/2003 | Bart et al. | |
| 2006/0057933 | A1 * | 3/2006 | Bricker | A63H 33/004 446/327 |

(Continued)

FOREIGN PATENT DOCUMENTS

JP 3228771 U 11/2020

*Primary Examiner* — John A Ricci

(74) *Attorney, Agent, or Firm* — Amundsen Davis. LLC

(57) ABSTRACT

A three-dimensional transformable toy having a body with a first surface and a second surface and having a hollow cavity formed therein. A flexible fill material is positioned between the first and second surfaces. The toy also has expandable/contractable member positioned between the first and second surfaces and which surrounds an opening leading to the hollow cavity. The expandable/contractable member permits the opening to expand in size and contract in size as the body switches between the first and second configurations. The expandable/contractable member further creates a relatively flat bottom surface which allows the toy to stand upright in both the first and second configurations.

15 Claims, 10 Drawing Sheets

(56) References Cited

U.S. PATENT DOCUMENTS

| | | | | |
|---|---|---|---|---|
| 2014/0220851 | A1* | 8/2014 | Bennett | A63H 33/003 446/72 |
| 2017/0136375 | A1* | 5/2017 | Narayanan | A63H 3/12 |
| 2019/0184298 | A1 | 6/2019 | Badie | |

* cited by examiner

THREE-DIMENSIONAL TRANSFORMABLE TOY

CROSS-REFERENCE TO RELATED APPLICATION

This application claims the benefit of U.S. Provisional Application No. 63/305,017, filed Jan. 31, 2022, and titled: THREE-DIMENSIONAL TRANSFORMABLE TOY.

FIELD OF THE INVENTION

The present invention relates to a soft toy, and more specifically, to a three-dimensional transformable toy having an expandable/contractable member surrounding an opening to a hollow cavity.

BACKGROUND OF THE INVENTION

Toys adapted to transform from one configuration to another are known in the art and cover a wide range of toys from soft object figurines to mechanical robots that convert into vehicles. Although there are a variety of toys that provide some transition, it is important to have a toy that can be easily and quickly transformed between first and second configurations by a young child. The transformation will present different appearances or configurations to the child. It is also important that the toy can stand upright in either configuration.

Now, a three-dimensional transformable toy has been invented which can be easily manipulated by a young child and which can stand upright in either configuration.

SUMMARY OF THE PRESENT INVENTION

Briefly, this invention relates to a three-dimensional transformable toy having a body with a first surface and a second surface. The first surface defines a complete outer surface of the toy in a first configuration and the second surface defines a complete outer surface of the toy in a second configuration. A hollow cavity is formed in between the first and second surfaces. The toy also has an expandable/contractable member positioned between the first and second surfaces and which surrounds an opening leading to the hollow cavity. The expandable/contractable member permits the opening to expand in size and contract in size as the body switches between the first and second configurations. The opening is of sufficient size when expanded wherein at least portions of the body can collapse through the expanded opening when the body is moved between the first and second configurations, and vice versa. The expandible/contractable member further creates a relatively flat bottom surface for the body which allows the toy to stand upright in both the first and second configurations.

In another aspect, there is also provided a three-dimensional transformable toy. More specifically, this aids in providing a three-dimensional transformable toy having a body with a first surface and a second surface, and having a hollow cavity formed therebetween, and an expandable/contractable member which surrounds an opening leading to a hollow cavity located between the first and second surfaces, wherein at least portions of the body can collapse through the opening when the body is moved between the first and second configurations, and vice versa.

There is also disclosed a three-dimensional transformable toy having a body which can stand upright in both the first and second configurations. Additionally or alternately, this can aid to provide a three-dimensional transformable toy which is easy to manufacture and can be manufactured at a reasonable cost. Additionally or alternately, the toy is innovative in its educational aspect, through which, even when the child is playing alone will learn about animals coming from an egg. That is, through play, the toy enhances the creativity and sensitivity of the child, who comes to know more about nature and the world around it.

Further, the inventors have developed an improved transformable toy figure, in which a small child could more easily handle the toy, as there are no moving parts or multiple attachments to the toy in any configuration. And preferably, the toy is made entirely in plush fabric or similar materials and flexible filling, not possessing any kind of rigid zones, sharp edges or zippers, so that this simplicity and safety of materials and techniques facilitates the use of the toy by children, especially really young children.

Other advantages of the present invention will become more apparent to those skilled in the art in view of the following description and the accompanying drawings.

DETAILED DESCRIPTION OF THE INVENTION

Figure 1:
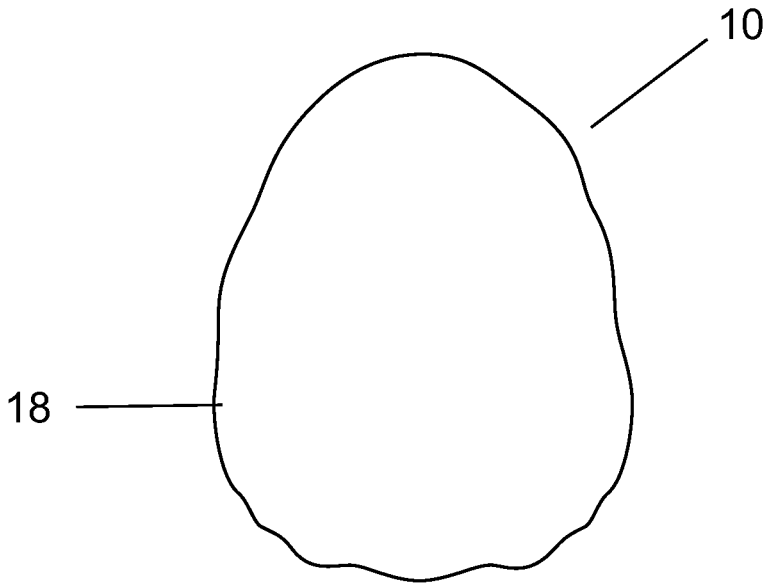
FIG. 1 is a frontal perspective view of a three-dimensional transformable toy having a body in a first configuration which resembles an egg.

Referring to FIGS. 1-5, a three-dimensional transformable toy 10 is shown. The three-dimensional transformable toy 10 can be a soft fabric toy which can acquire two different and unique configurations to provide a young child with an element of surprise. Similar to the childhood game of: "PEEK-A-BOO" the child, one of their parents, or another person, can cause elements of the toy 10 to appear and disappear at will. The three-dimensional transformable toy 10 has a body 12 with a first surface 14 and a second surface 16. The first surface 14 defines a complete outer surface of the toy 10 in a first configuration 18 and the second surface 16 defines a complete outer surface of the toy 10 in a second configuration 20. Each of the first and second surfaces, 14 and 16 respectively, can be formed from a fabric. The fabric can be formed from natural fibers, synthetic fibers or a combination of natural and synthetic fibers. By "synthetic' it is meant produced by synthesis, not of natural origin. For example, the fabric can be formed from various shrubby plants of the genus *Gossypium*, grown for the soft white downy fibers surrounding oil-rich seeds. On example of such natural fibers is cotton. The fabric can also be any of several synthetic textile fibers produced by forcing a cellulose solution through fine spinnerets and solidifying the resulting filaments. The fabric can be woven or knitted. Examples of synthetic fibers include but are not limited to: rayon, polyester, polypropylene, polyethylene or other thermoplastics known to those skilled in the art.

Figure 5:
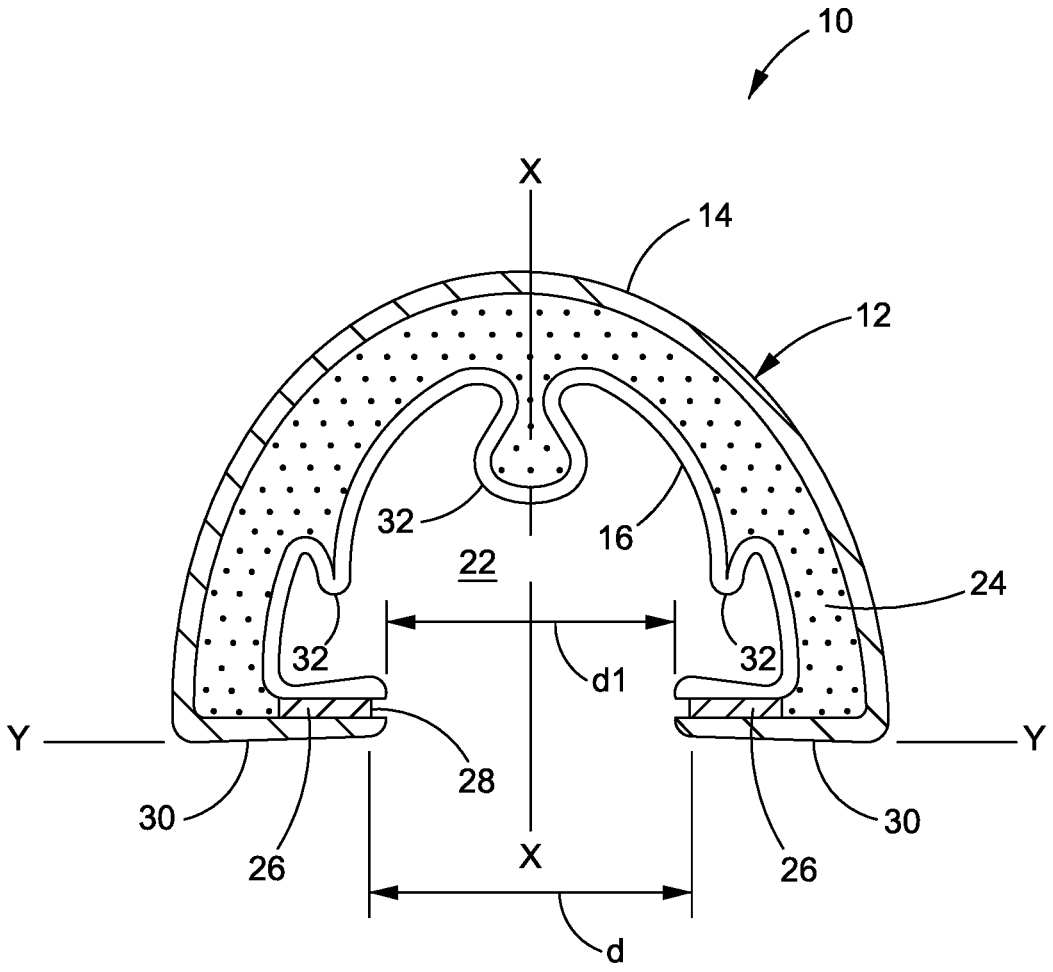
FIG. 5 is a vertical cross-sectional view of that shown in FIG. 1, now emphasizing the expandable/contractable member and its hollow cavity and flexible filling material.
Figure 6:
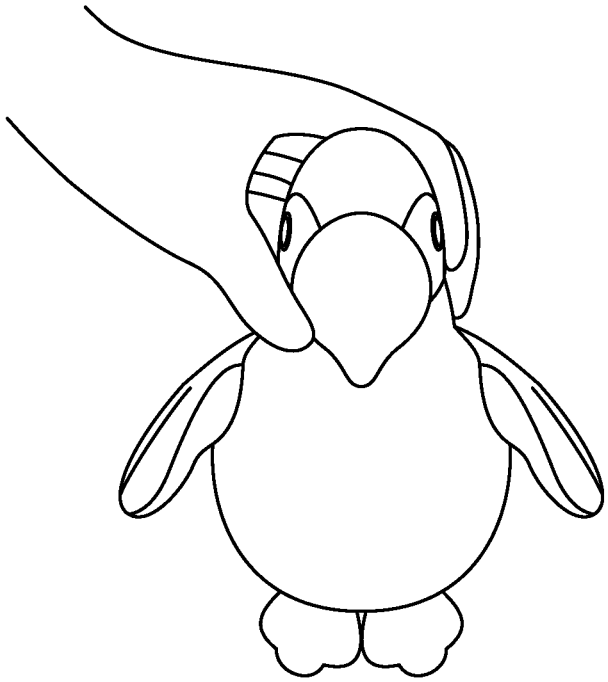
FIG. 6 is frontal view of that shown in FIG. 2, as held by a user.
Figure 7:
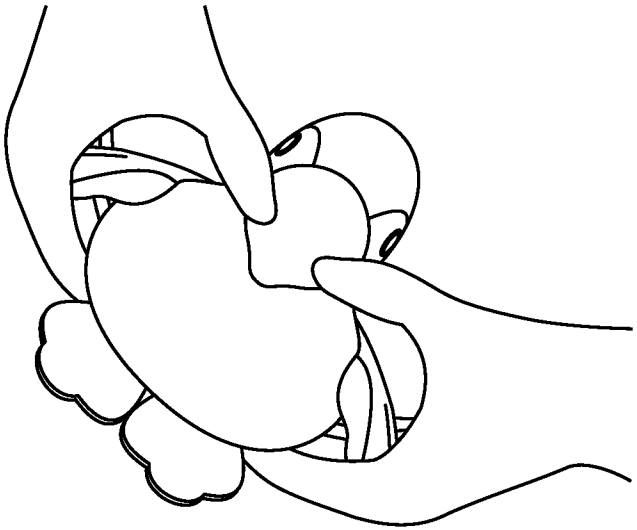
FIG. 7 is the toy shown in FIG. 6 being transformed from its second configuration into its first configuration, that being the egg as shown in FIG. 1.
Figure 8:
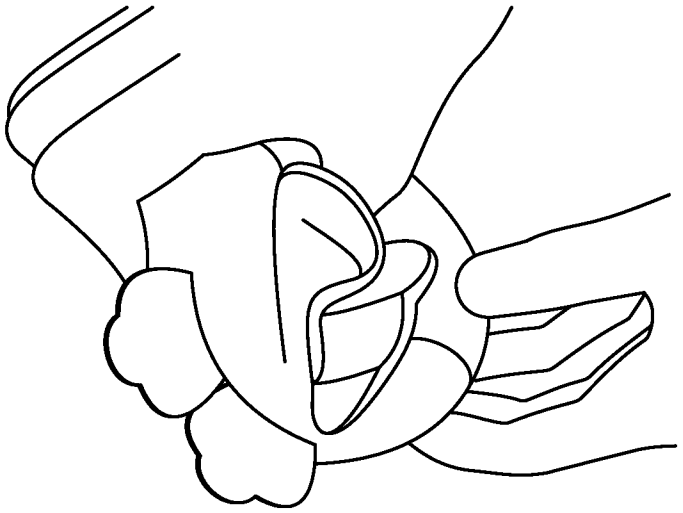
FIG. 8 is the toy shown in FIG. 7 further along in its transformation toward the first configuration.
Figure 9:
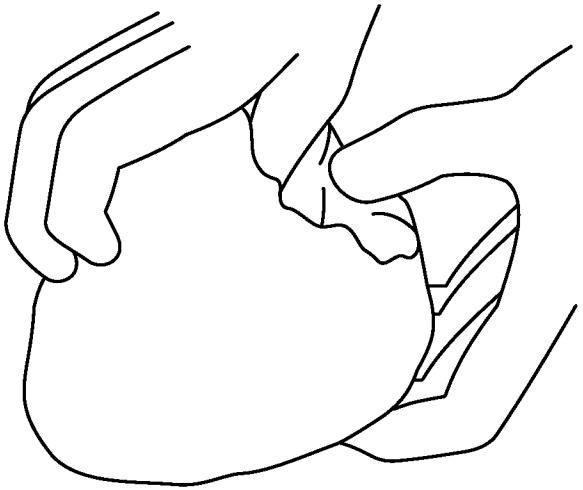
FIG. 9 is the toy shown in FIG. 8 having been fully transformed into its first configuration, that being the egg.
Figure 10:
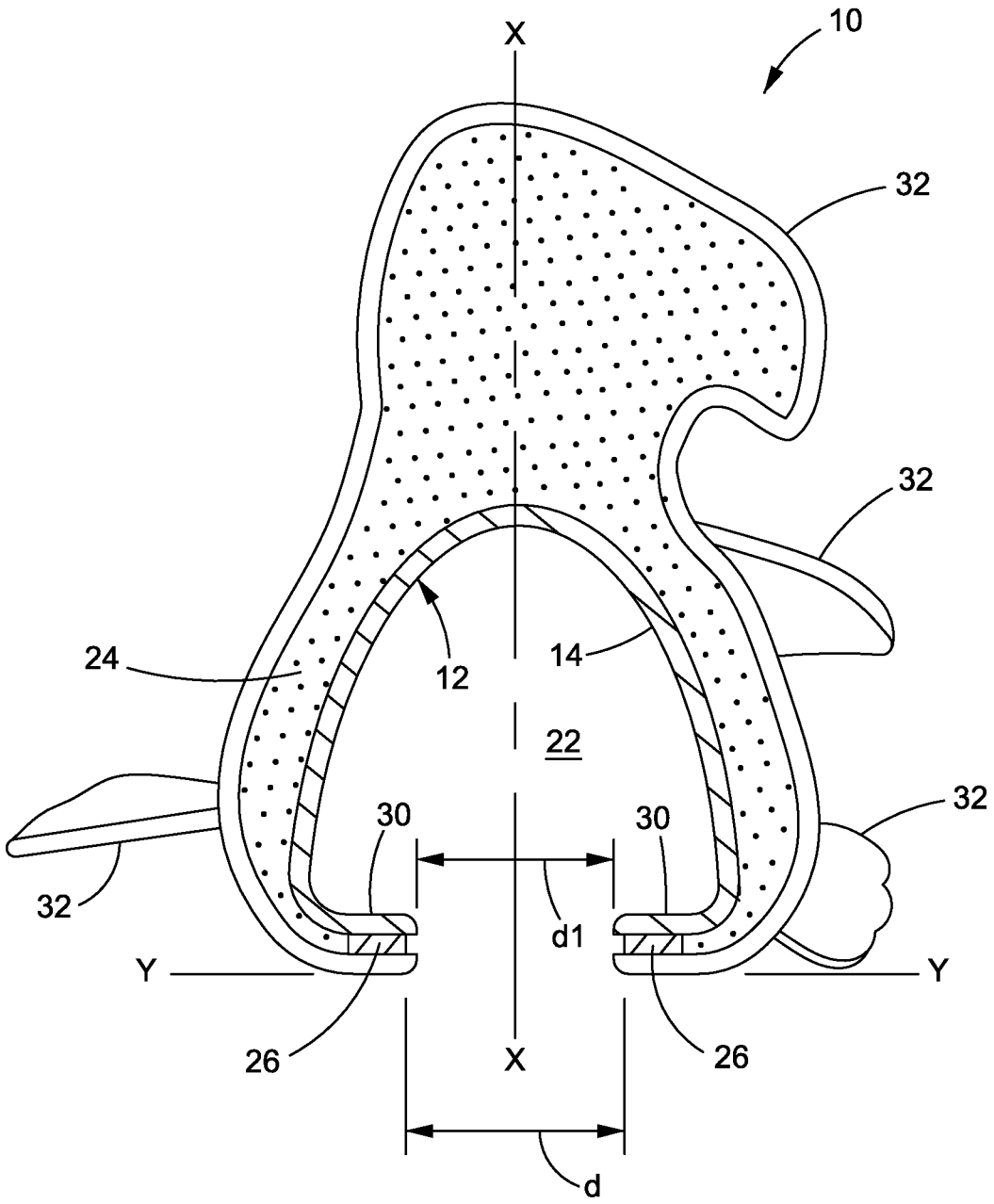
FIG. 10 is a vertical cross-sectional view of that shown in FIG. 2, now emphasizing the expandable/contractable member and its hollow cavity and flexible filling material.

Referring now to FIGS. 5 and 10, the body 12 also has a hollow cavity 22 formed in between the first and second surfaces, 14 and 16 respectively. The size, shape and configuration of the hollow cavity 22 can vary. A flexible fill material 24 is positioned between the first and second surfaces. The flexible fill material 24 functions to provide bulk and thickness to the toy 10. The flexible fill material 24 can be any of a plurality of natural or synthetic materials. The flexible fill material 24 can vary in size, dimension and configuration. The flexible fill material 24 can have a spherical shape, an irregular shape or any other shape known to one skilled in the art. The flexible fill material 24 could be a bead, a pellet, a sand particle, a sphere, a small round object, a small object having some other geometrical shape, a granule, etc. The flexible fill material 24 can vary in size. For example, the size of the flexible fill material can range from between about 1 millimeter to about 25 millimeters. More desirably, the size of the flexible fill material 24 can range from the size of a grain of sand, which is about 2 millimeters in diameter, up to the size of a pebble, which is about 10 millimeters in diameter. The shape of the flexible fill material 24 can also vary. The flexible fill material 24 could be a sphere, or some other geometrical shape known to one skilled in the art. The flexible fill material 24 can be formed from many different materials or a combination of different materials. For example, the flexible fill material 24 could be particles of sand, plastic spheres, wooden spheres, cotton, cotton balls, etc., in addition, the flexible fill material 24 could be formed from a closed cell foam, an open cell foam, Styrofoam, styrene, polystyrene, polypropylene, polyethylene, other thermoplastic materials, or combinations thereof. STYROFOAM is a trademark used for a light resilient polystyrene plastic.

Still referring to FIGS. 5 and 10, the three-dimensional transformable toy 10 also includes an expandable/contractable member 26. The expandable/contractable member 26 is positioned between the first and second surfaces, 14 and 16 respectively. The expandable/contractable member 26 can be an elastic member. Desirably, the expandable/contractable member 26 is a closed loop elastic band, such as a rubber band. The height, width and inner diameter of the expandable/contractable member 26 can vary. For example, the expandable/contractable member 26 can have a height (h) ranging from between about 2 millimeters to about 8 millimeters, a width (w) ranging from between about 4 millimeters to about 12 millimeters, and a non-expanded inner diameter (d) ranging from between about 0.6 inches to about 3.1 inches. The expandable/contractable member 26 can be secured between the first and second surfaces, 14 and 16 respectively, to retain it in position without restricting its ability to expand and contract. Various methods of securing the expandable/contractable member 26 can be used which are known to those skilled in the art. For example, a plurality of loops (not shown) can be utilized through which the expandable/contractable member 26 passes. The loops can be similar to belt loops on a pair of jeans through which a belt can pass. The loops can be sewn, stitched, glued or fastened by some other means to either the first surface 14, to the second surface 16 or to both the first and second surfaces, 14 and 16 respectively. Alternatively, the expandable/contractable member 26 can be sewn or stitched to the first and/or second surfaces, 14 and/or 16 respectively, in a fashion that does not prevent it from expanding and contracting. A third way to secure the expandable/contractable member 26 is to intermittently apply glue or an adhesive between the first and second surfaces, 14 and 16 respectively, and secure the expandable/contractable member 26 in a fashion that does not prevent it from expanding and contracting. It should be noted that the method used to secure the expandable/contractable member 26 between the first and second surfaces, 14 and 16 respectively, should establish its position within the toy 10.

Still referring to FIGS. 5 and 10, the expandable/contractable member 26 surrounds an opening 28 which leads to the hollow cavity 22. In other words, the opening 28 can provide ingress or egress to or from the hollow cavity 22. The opening 28 has an initial periphery. The size and shape of the opening 28 can vary. Generally, the size or initial diameter ($d_1$) of the opening 28 is slightly less than the inner diameter (d) of the expandable/contractable member 26, and in this way further ensure an even softer edge to the opening. The opening 28 can have a diameter ($d_1$) of from between about 0.5 inches to about 3 inches. Desirably, the diameter ($d_1$) of the opening 28 ranges from between about 1 inch to about 2.5 inches. More desirably, the diameter ($d_1$) of the opening 28 ranges from between about 1.25 inches to about 2.25 inches. Even more desirably, the diameter ($d_1$) of the opening 28 ranges from between about 1.3 inches to about 2.2 inches. Most desirably, the diameter ($d_1$) of the opening 28 is greater than about 1.4 inches.

The expandable/contractable member 26 functions to permit the opening 28 to expand in size and contract in size as the body 12 switches between the first and second configurations, 18 and 20 respectively, and vice versa. The opening 28 is of sufficient size, when expanded, wherein at least portions of the body 12 can collapse through the expanded opening 28 when the body 12 is moved or pushed between the first and second configurations, 18 and 20 respectively, and vice versa. The expandable/contractable member 26 can increase the initial periphery of the opening 28 by at least about 1.5 times when the opening 28 is expanded. Desirably, the expandable/contractable member 26 can increase the initial periphery of the opening 28 by at least about 2 times when the opening 28 is expanded. More desirably, the expandable/contractable member 26 can increase the initial periphery of the opening 28 by more than about 2 times when the opening 28 is expanded.

Referring now to FIGS. 3-5 and 10, the expandible/contractable member 26 further functions to create a relatively flat bottom surface 30 for the body 12 which allows the toy 10 to stand upright in both the first and second configurations, 18 and 20 respectively. The relatively flat bottom surface 30 is important because many children prefer to position their toy 10 in a vertical upright position when they are not carrying it around with them. The vertical upright position is how they would envision the animal when they see it in nature or at a zoo.

Figure 2:
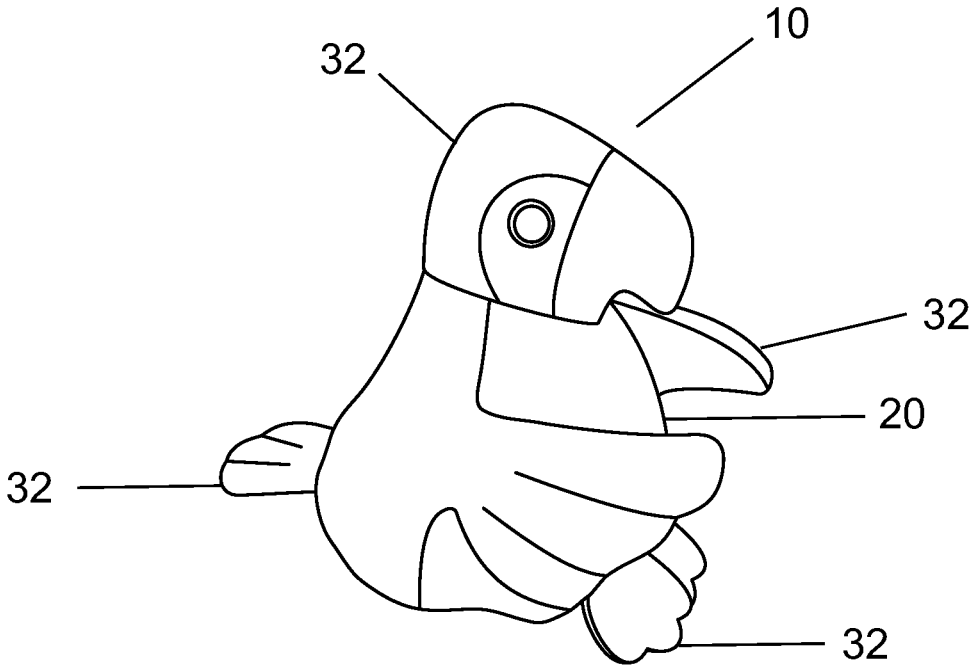
FIG. 2 is a side perspective of that shown in FIG. 1, now having a body with a second configuration which resembles a macaw.
Figure 3:
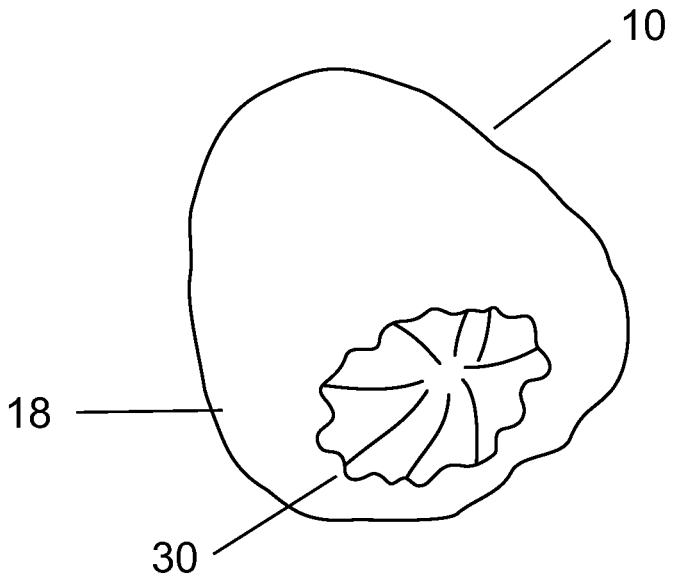
FIG. 3 is a bottom-up perspective view of that shown in FIG. 1, now emphasizing a relatively flat bottom surface which allows the body to stand upright while in the first configuration.
Figure 4:
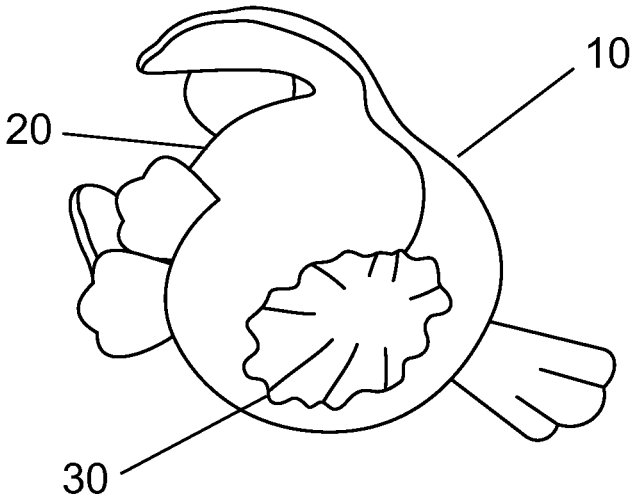
FIG. 4 is a bottom-up perspective view of that shown in FIG. 2, now emphasizing a relatively flat bottom surface which allows the body to stand upright while in the second configuration.

Referring again to FIGS. 2 and 5, the body 10 of the toy 10 can contain one or more figure-forming elements 32. The figure-forming elements 32 can represent a head, wings, feet, a tail, etc. In FIG. 2, the toy 10 is constructed as an animal, depicted as a macaw. A macaw is any of various parrots of the genera Ara and Anodorhynchus of Central and South America, characterized by long tails, curved bills, and usually brilliant plumage. The figure-forming elements 32 are shaped and dimensioned such that the toy 10, in its second configuration 20, resembles an animal which is normally hatched from an egg. The figure-forming elements 32 (head, wings, feet and tail), work together to create a cute, appealing fanciful macaw-like animal.

It should be noted that the toy 10 can be made to resemble any animal or an insect. The animal can be hatched from an egg, such as a bird, an eagle, an owl, a turtle, a snake, a frog, a fish, an alligator, etc. Alternatively, an insect can emerge from a cocoon, such as a butterfly or a ladybug. By "cocoon" it is meant a protective case of silk or similar fibrous material spun by the larvae or moths and other insects that serve as a covering for their pupal stage.

It should also be understood that the toy 10 can be constructed in any desirably size and be of any color. The size of the toy 10 does not have to correspond with the actual size of the animal it represents. In addition, the color or colors of the toy should appeal to a young child. A variety of different colors can be used. The colors don't have to exactly match the natural colors of the animal or insect.

Method

A method of reversing the three-dimensional transformable toy 10 is taught herein. The three-dimensional transformable toy 10 includes a body 12 having a first surface 14 and a second surface 16. The first surface 14 defines a complete outer surface of the toy 10 in a first configuration 18 and the second surface 16 defines a complete outer surface of the toy 10 in a second configuration 20. A hollow cavity 22 is formed between the first and second surfaces, 14 and 16 respectively. The body 12 contains a flexible fill material 24 positioned between the first and second surfaces, 14 and 16 respectively. An expandable/contractable member 26 is positioned between the first and second surfaces, 14 and 16 respectively. The expandable/contractable member 26 surrounds an opening 28 which leads to the hollow cavity 22. The expandable/contractable member 26 permits the opening 28 to expand in size and contract in size as the body 12 switches between the first and second configurations, 14 and 16 respectively. The opening 28 is of sufficient size, when expanded, wherein at least portions of the body 12 can collapse through the expanded opening 28 when the body 12 is moved between the first and second configurations, 14 and 16 respectively, and vice versa. The expandible/contractable member 26 further creates a relatively flat bottom surface 30 for the body 12 which allows the toy 10 to stand upright in both the first and second configurations, 14 and 16 respectively.

Referring to FIGS. 6-9, there is shown the sequence used to transform the three-dimensional transformable toy 10. Starting with the toy 10 in its second configuration 20, wherein the body 12 is in the shape of an animal, a macaw in this example. The method includes the steps of grasping the toy 10, see FIG. 6, and pushing or moving the second surface 16 downward towards and through the opening 28, see FIG. 7. The child or person can do this using one or both hands. It is easier to use both hands. By continuing this pushing action, the first surface 14 will emerge out of the opening 28, see FIG. 8. This pushing is continued until the first surface 14 forms a complete outer surface of the toy 10, in this case, an egg, see FIG. 9. And then, going in reverse from FIG. 9 back to FIG. 6, the process is reversed, and the toy ultimately looks like that in FIG. 2 also.

It should be understood that the toy 10 can be transformed back and forth between its first and second configurations, 18 and 20 respectively. Starting with the toy 10 in its first configuration 18, wherein the body 12 is in the shape of an egg, see FIG. 1. The method includes the steps of grasping the toy 10 and pushing or moving the first surface 14 downward towards and through the opening 28. The child or person can do this using one or both hands. It is easier to use both hands. By continuing this pushing action, the second surface 16 will emerge out of the opening 28. This pushing is continued until the second surface 16 forms a complete outer surface of the toy 10, in this case, a macaw.

Each and every document cited in this present application, including any cross referenced or related patent or application, is incorporated in this present application in its entirety by this reference, unless expressly excluded or otherwise limited. The citation of any document is not an admission that it is prior art with respect to any embodiment disclosed in this present application or that it alone, or in any combination with any other reference or references, teaches, suggests, or discloses any such embodiment. Further, to the extent that any meaning or definition of a term in this present application conflicts with any meaning or definition of the same term in a document incorporated by reference, the meaning or definition assigned to that term in this present application governs.

The invention includes the description, examples, features, embodiments, and drawings disclosed; but it is not limited to such description, examples, features embodiments, or drawings. As briefly described above, the reader should assume that features of one disclosed embodiment can also be applied to all other disclosed embodiments, unless expressly indicated to the contrary. Unless expressly indicated to the contrary, the numerical parameters set forth in the present application are approximations that can vary depending on the desired properties sought to be obtained by a person of ordinary skill in the art without undue experimentation using the teachings disclosed in the present application. Modifications and other embodiments will be apparent to a person of ordinary skill in the animal leash arts, and all such modifications and other embodiments are intended and deemed to be within the scope of the invention.

What is claimed is:

1. A three-dimensional transformable toy comprising:

a) a body having a first surface and a second surface, the first surface defining a complete outer surface of the toy in a first configuration wherein in the first configuration the toy resembles an egg, the second surface defining a complete outer surface of the toy in a second configuration wherein in the second configuration the toy resembles an animal which has hatched from the egg, and the first and second surfaces having a hollow cavity formed therein;

b) a flexible fill material positioned between the first and second surfaces; and c) an expandable/contractable member of elastic positioned between the first and second surfaces and which surrounds an opening to the hollow cavity, the expandable/contractable member permitting the opening to expand in size and contract in size as the body switches between the first and second configurations, the opening has an initial periphery which can increase in size by at least about 1.5 times when the opening is expanded wherein at least portions of the body can collapse through the expanded opening when the body is moved between the first and second configurations and vice versa and wherein the expandible/contractable member further creates a relatively flat bottom surface for the body which allows the toy to stand upright in both the first and second configurations.

2. The three-dimensional transformable toy of claim 1 wherein the expandable/contractable member is an elastic band.

3. The three-dimensional transformable toy of claim 2 wherein the first surface is formed from a fabric and the elastic band forms a closed loop.

4. The three-dimensional transformable toy of claim 2 wherein the second surface is formed from a fabric and the elastic band forms a closed loop which is secured to the first and second surfaces.

5. The three-dimensional transformable toy of claim 1 wherein the flexible fill material is a synthetic material.

6. The three-dimensional transformable toy of claim 1 wherein the opening has an initial periphery which can increase in size by at least about 2 times when the opening is expanded.

7. The three-dimensional transformable toy of claim 1 wherein in the second configuration the toy resembles an insect which has emerged from a cocoon.

8. The three-dimensional transformable toy of claim 1 wherein the toy resembles a macaw.

9. The three-dimensional transformable toy of claim 1 wherein the toy is constructed entirely of flexible materials and devoid of any rigid zones, sharp edges and zippers.

10. A method of reversing the three-dimensional transformable toy, the three-dimensional transformable toy including a body having a first surface and a second surface, the first surface defining a complete outer surface of the toy in a first configuration wherein in the first configuration the toy resembles an egg, the second surface defining a complete outer surface of the toy in a second configuration wherein in the second configuration the toy resembles an animal which has hatched from the egg, and the first and second surfaces having a hollow cavity formed therein; and an expandable/contractable member of elastic positioned between the first and second surfaces and which surrounds an opening to the hollow cavity, the expandable/contractable member permitting the opening to expand in size and contract in size as the body switches between the first and second configurations, the opening having an initial periphery which can increase in size by at least about 1.5 times when the opening is expanded and being of sufficient size when expanded wherein at least portions of the body can collapse through the expanded opening when the body is moved between the first and second configurations and vice versa, the method comprising the steps of:

a) pushing the first surface through the opening which causes the second surface to begin to emerge out of the opening;

b) continuing to push the first surface through the opening until the second surface forms a complete outer surface of the toy; and c) creating a relatively flat bottom surface for the body which allows the toy to stand upright in both the first and second configurations.

11. The method of claim 10 further comprising locating a flexible fill material between the first and second surfaces.

12. The method of claim 10 wherein the step of creating comprises the expandible/contractable member contributing to the relatively flat bottom surface.

13. The method of claim 10 further comprising using the toy constructed entirely of flexible materials and devoid of any rigid zones, sharp edges and zippers.

14. The method of claim 10 further comprising the steps of:

c) pushing the second surface through the opening which causes the first surface to begin to emerge out of the opening; and d) continuing to push the second surface through the opening until the first surface forms a complete outer surface of the toy.

15. The method of claim 10 further comprising a user using two hands to do the steps of pushing and continuing to push.

* * * * *